United States Patent [19]

Minear

[11] Patent Number: 5,071,116

[45] Date of Patent: Dec. 10, 1991

[54] PEDAL OPERATED EXERCISING DEVICE

[75] Inventor: Alan C. Minear, 9120 Roundleaf Way, Gaithersburg, Md. 20879

[73] Assignee: Alan C. Minear, Gaithersburg, Md.

[21] Appl. No.: 611,894

[22] Filed: Nov. 13, 1990

Related U.S. Application Data

[63] Continuation of Ser. No. 401,777, Sep. 1, 1989, abandoned.

[51] Int. Cl.[5] ..... A63B 21/00

[52] U.S. Cl. ..... 272/73; 272/96

[58] Field of Search ..... 272/73, 93, 94, 96, 272/128, 131, 132, 133, 126; 128/25 R

[56] References Cited

U.S. PATENT DOCUMENTS

| | | | |
|---|---|---|---|
| 3,566,861 | 3/1971 | Weiss | 272/96 |
| 3,713,438 | 1/1973 | Knutsen | 272/73 |
| 4,645,200 | 2/1987 | Hix | 272/73 |
| 4,705,493 | 11/1987 | Lin | 272/73 |
| 4,915,375 | 4/1990 | Ginsburg | 272/73 |

*Primary Examiner*—Stephen R. Crow

[57] ABSTRACT

A pair of foot pedals of an exercising device supported by rollers on a floor surface externally of a housing are interconnected by a linkage arrangement within the housing for simultaneous displacement in opposite direction in response to the prevailing foot pressure applied to either one of the pedals. The linkage arrangement is drivingly connected through one-way clutches to a common loading disc through which foot pressure applied to either of the pedals is resisted by a selectively adjusted amount to suit the user of the exercising device.

17 Claims, 4 Drawing Sheets

PEDAL OPERATED EXERCISING DEVICE

BACKGROUND OF THE INVENTION

This invention relates to exercising devices of the type involving a pair of pedals to which foot pressure is applied by the user as disclosed in my prior copending application, Ser. No. 07/401,777 filed Sept. 1, 1989 (abandoned), with respect to which the present application is a continuation.

Foot pedal exercising devices ar generally well known in the art. Such devices disclosed for example, in U.S. Pat. Nos. 3,525,522 and 4,603,851 to Piller and Russell, respectively, are designed with cost economy and portability in mind. Adjustable frictional resistance to foot pressure applied to the pedals, was also featured in the Piller patent even though its application is somewhat ineffective. As to the use of a foot pedal operated exercising device which allows performance of other work tasks while the user is seated in an office, U.S. Pat. No. 4,452,449 to Propst is of interest. Such objective of the invention disclosed in the Propst patent, is not however consistent with the portability and economy objectives associated with the teachings in the Piller and Russell patents aforementioned.

Although the provision of effective means for adjusting resistance to foot pressure is disclosed in U.S. Pat. No. 3,702,188 to Phillips et al, the reliance on hydraulic cylinders for such purpose and the provision of various related functional features renders the exercising device disclosed in the Phillips patent rather bulky and subject to malfunction.

It is therefore an important object of the present invention to provide a foot pedal type of exercising device arranged to embody all of the inconsistent objectives of the aforementioned prior art devices, including portability, cost economy, adjustability with respect to foot pressure resistance and suitability for use during the performance of other tasks.

SUMMARY OF THE INVENTION

In accordance with the present invention, a pair of foot pedals are interconnected by a transmitting linkage arrangement enforcing simultaneous pivotal displacement of the pedals under foot pressure applied to either one of the pedals. The linkage arrangement includes links respectively connected to the pedals in spaced relation to roller supports pivotally mounting the pedals independently and externally of a protective housing into which the links extend. The linkage arrangement also includes force transmitting ball bearings within a guide tube having opposite ends into which the links project, causing the links to undergo relative movement by equal amounts in opposite directions in response to pivotal displacement imparted to one of the pedals. Gear rack formations on the links in mesh with pinion gears alternatively transmit rotation in one direction through one-way clutches to a common disc through which the foot pressure receiving pedal is loaded by the linkage arrangement. Regulated loading of either one of the pedals being depressed under foot pressure is thereby effected as a result of frictional resistance against rotation applied to the loading disc by a flexible strap or band in frictional engagement therewith under a tension that is adjustable to suit the user.

Further objects and advantages of the present invention may be best understood by reference to the following detailed description taken in conjunction with the accompanying drawing.

BRIEF DESCRIPTION OF DRAWING FIGURES

Figure 5:
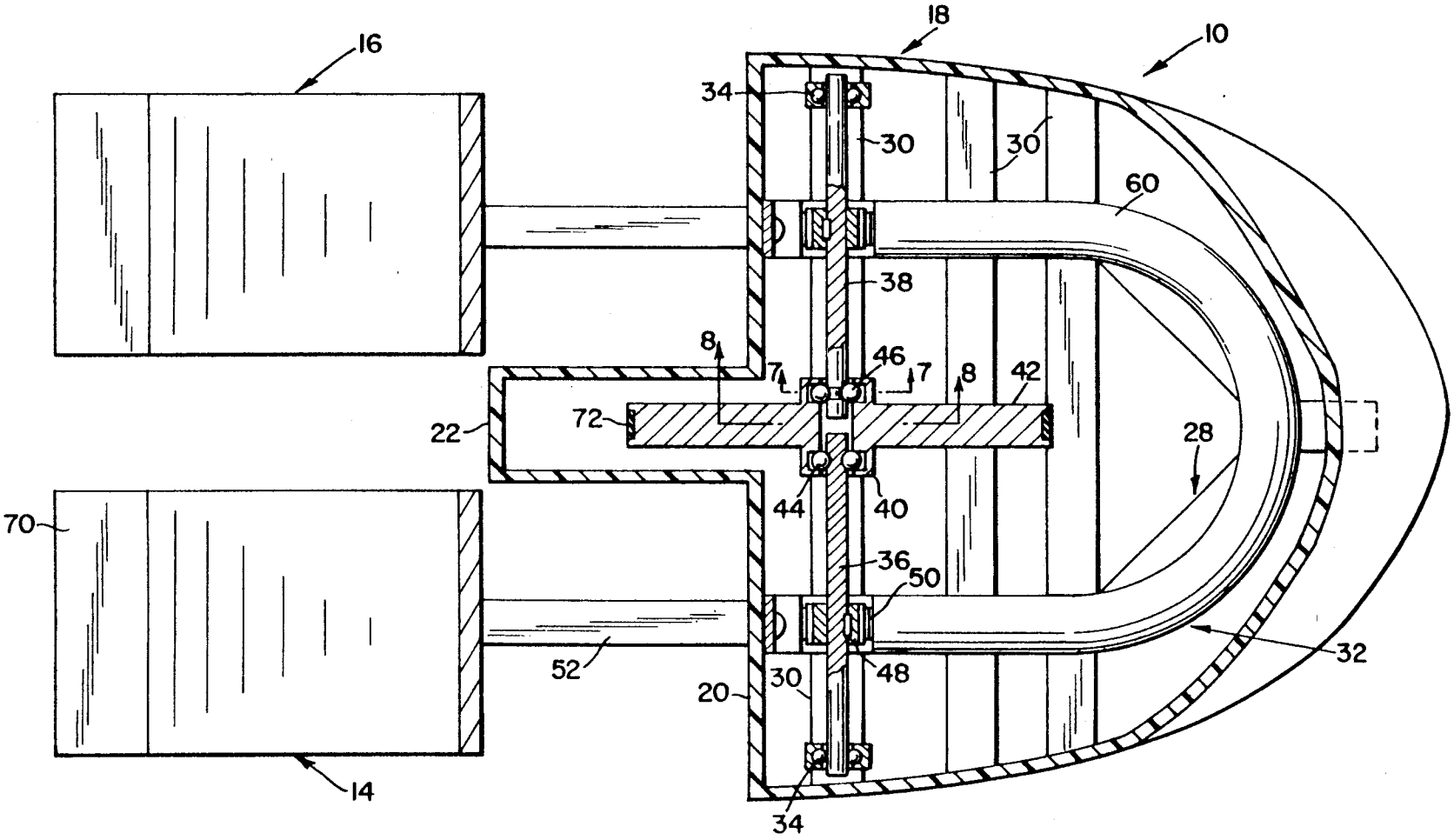
FIG. 5 is a top section view taken substantially through a plane indicated by section line 5—5 in FIG. 3.
Figure 7:
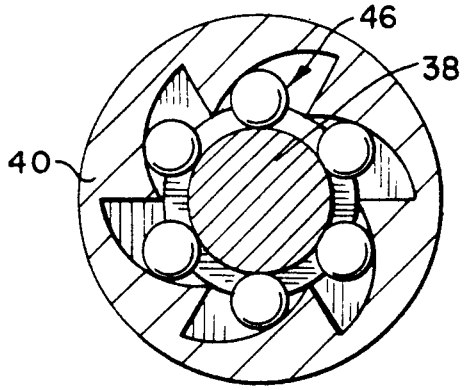
Figure 8:
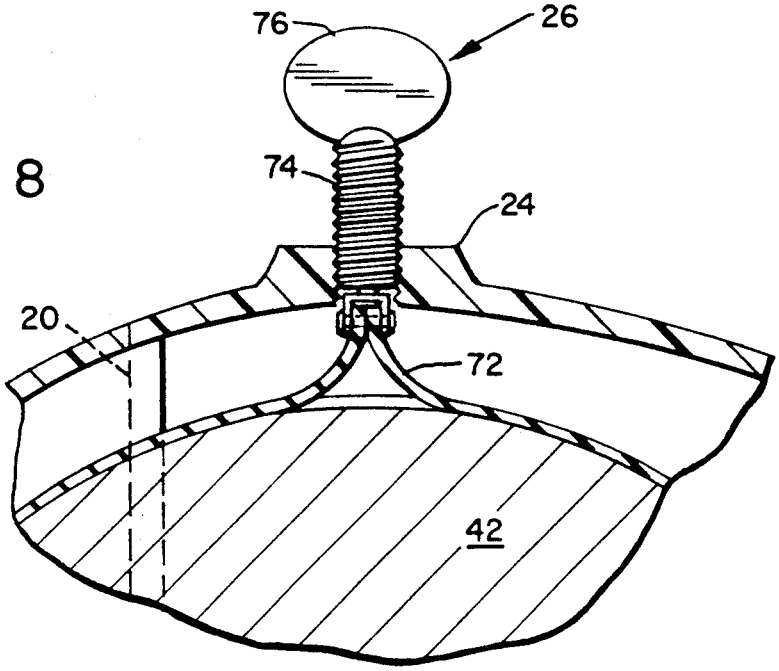

FIGS. 7 and 8 are enlarged partial section views taken substantially through planes indicated by section lines 7—7 and 8—8 in FIG. 5.

DETAILED DESCRIPTION OF PREFERRED EMBODIMENT

Figure 1:
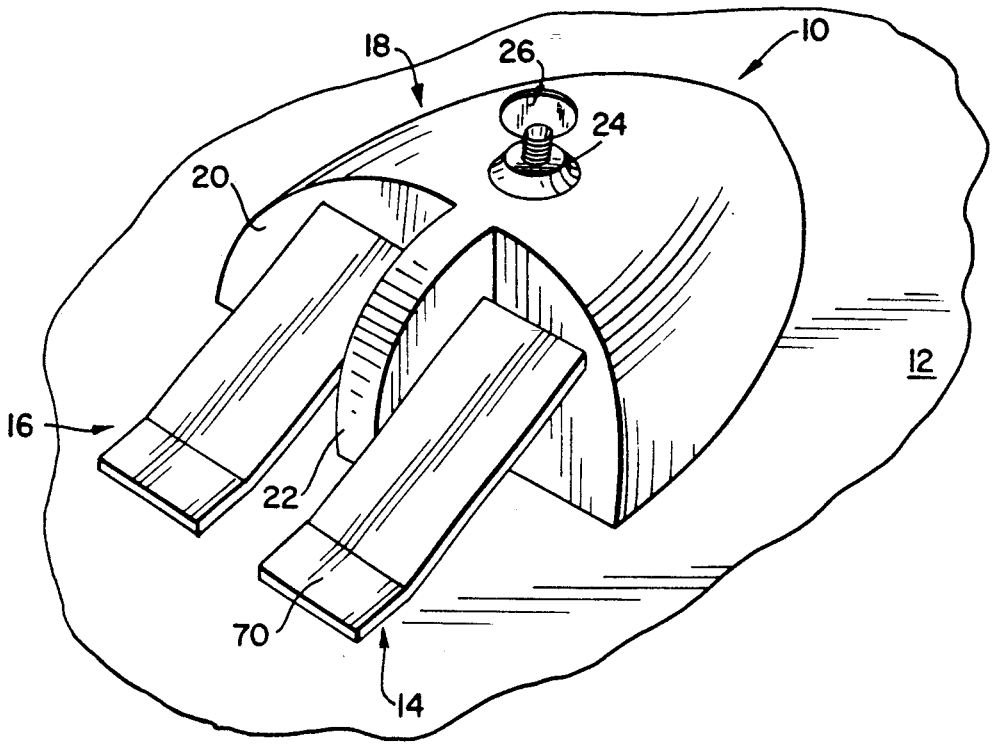
FIG. 1 is a perspective view of an exercising device constructed in accordance with one embodiment of the present invention.
Figure 2:
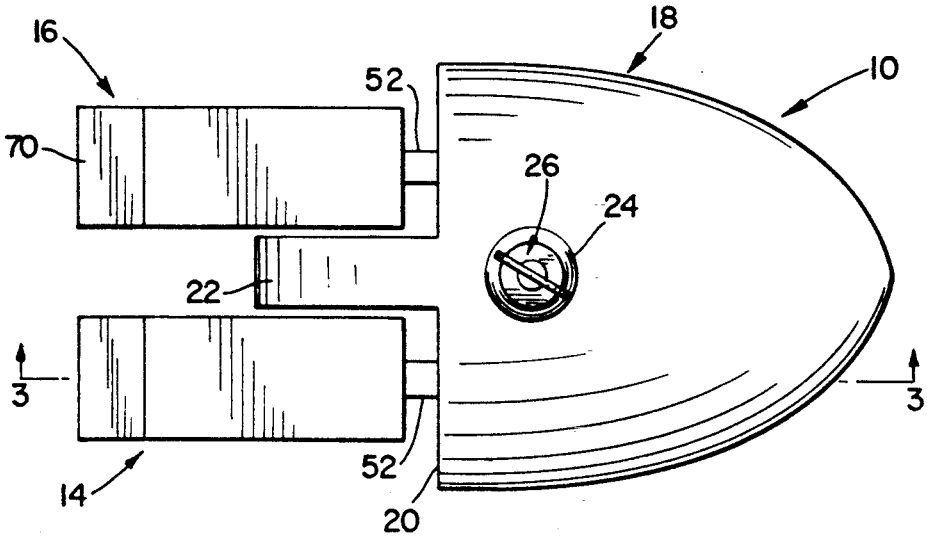
FIG. 2 is a top plan view of the exercising device shown in FIG. 1.

Referring now to the drawing in detail, FIGS. 1 and 2 illustrate an exercising device generally referred to by reference numeral 10 resting on a substantially flat floor surface 12. The device 10 includes a pair of foot pedals 14 and 16 extending in laterally spaced relation to each other toward a front wall 20 of a housing 18. The housing has a forwardly projecting portion 22 extending between the pedals and a central top portion having an upwardly projecting formation 24 mounting an adjustment means 26 through which resistance to foot pressure, exerted on either of the pedals 14 and 16 by the user of the device, may be adjusted as will be described in detail hereinafter.

Figure 3:
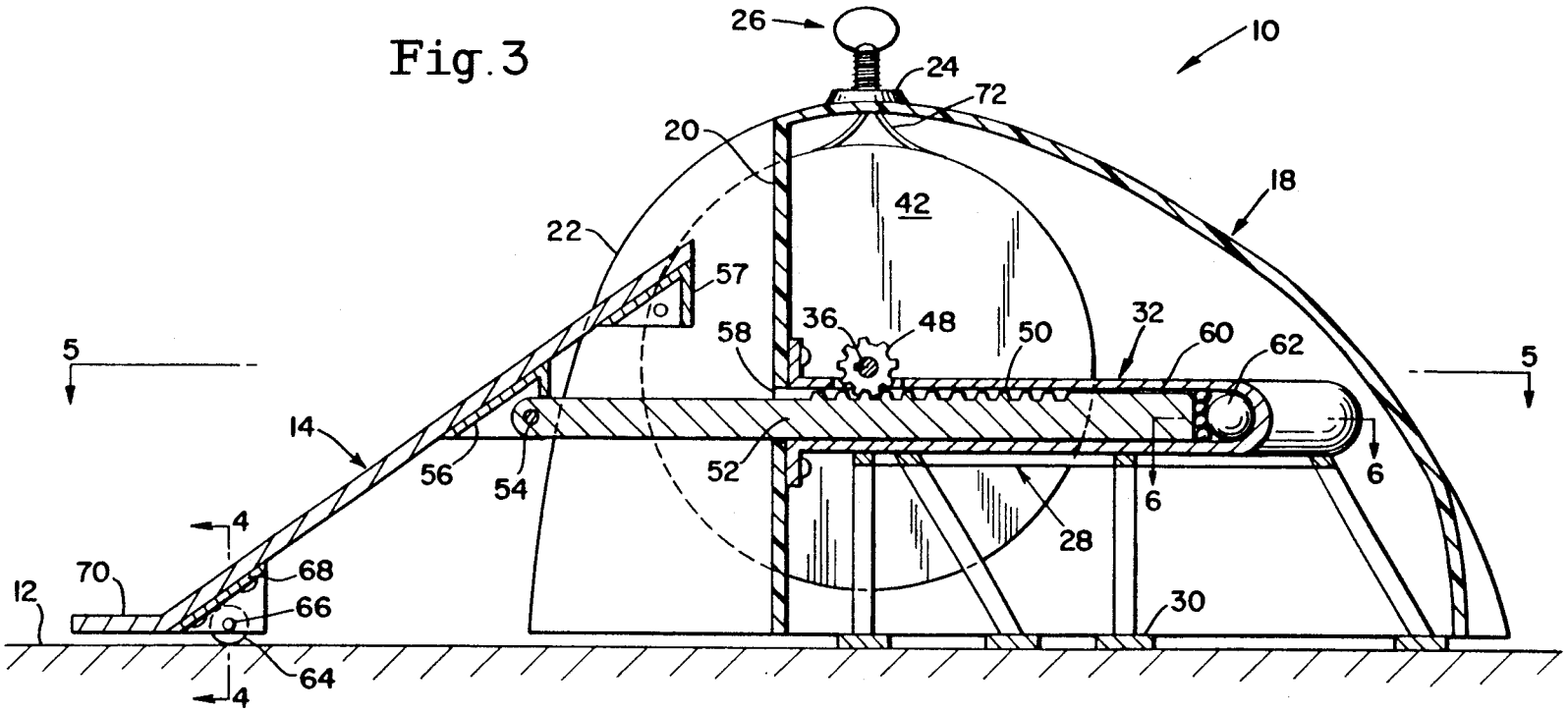
FIG. 3 is a side section view of the device taken substantially through a plane indicated by section line 3—3 in FIG. 2.

As more clearly seen in FIGS. 3 and 5 the housing encloses a frame assembly generally referred to by reference numeral 28 interconnected with the housing through a plurality of parallel spaced frictional supporting pads 30 resting on the floor surface 12. The frame assembly mounts a force transmitting linkage arrangement within the housing, generally referred to by reference numeral 32, through which the pedals 14 and 16 are interconnected for simultaneous displacement in opposite direction as will be explained in detail hereinafter. Bearing means 34 also mounted by the frame assembly 28 adjacent the side walls of the housing as shown in FIG. 5, rotatably mount a pair of axially aligned shafts 36 and 38. Adjacent ends of the shafts 36 and 38 are received within a hub portion 40 of a common loading disc 42 which is thereby rotatably mounted within the housing and enclosed by the portion 22 thereof between the pedals. A pair of one-way clutches 44 and 46 are associated With the hub portion 40 of the disc and are engageable in opposite rotational directions with the adjacent inner portions of shafts 36 and 38 for transmission of torque between the shafts and the common disc 42 through which the shafts are loaded. The shafts are respectively keyed at locations intermediate the one-way clutches and the bearings 34 to pinion gears 48.

Figure 6:
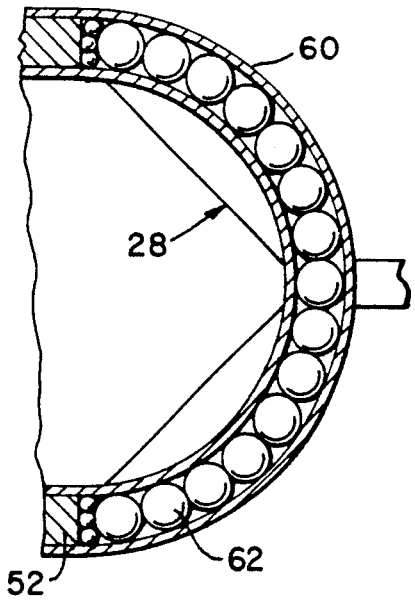
FIG. 6 is an enlarged partial section view taken substantially through a plane indicated by section line 6—6 in FIG. 3.

As shown in FIG. 3, each of the pinion gears 48 is in mesh with a gear rack formation 50 and a pair of links 52 associated with the linkage arrangement 32. Each link 52 is pivotally connected to a pedal 14 or 16 by a pin 54 fixed to a pivot bracket 56 secured to the underside of each pedal. The links 52 project through openings 58 in the front wall 20 of the housing into opposite open ends of a U-shaped guide tube 60 fixed to the front wall 20 of the housing and to the frame assembly 28. The ends of the links 52 within the guide tube are in engagement with ball bearings 62 slidably filling the guide tube, as more clearly seen in FIG. 6, in order to transmit forces between the links and enforce relative movement thereof in opposite directions by equal amounts in a positive fashion. Accordingly, pivotal displacement of either one of the pedals 14 and 16 in response to foot pressure applied thereto will cause the other pedal to be simultaneously displaced by the same amount in the opposite direction.

Figure 4:
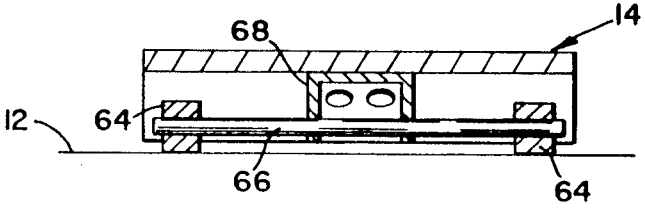
FIG. 4 is an enlarged partial section view taken substantially through a plane indicated by section line 4—4 in FIG. 3.

Each of the pedals is pivotally supported on the floor surface 12 independently of the housing and externally thereof in coplanar relation to the supporting pads 30 of the housing by rollers 64 as shown in FIGS. 3 and 4. A pair of such rollers are mounted by roller shaft 66 carried by a roller bracket 68 fixed to the underside of each pedal adjacent to an angulated end portion 70 remote from the housing.

The common disc 42 loads each of the shafts 36 and 38 in opposite directions through the associated one-way clutches 44 and 46 as aforementioned, one of which is shown in greater detail in FIG. 7, by way of example. The disc 42 is thereby operative to load the pedal from which torque applied to one of the shafts 36 and 38 originates. Loading by the disc 42 occurs because of the frictional resistance to rotation imposed by a flexible strap or band 72 in engagement with its outer periphery as more clearly seen in FIG. 8. The strap 72 is anchored to the housing for such purpose by the adjustment means 26, such as an externally threaded screw 74 to which the opposite ends of the strap are fixed, as shown by way of example. The adjustment screw is accordingly threaded through the formation 24 provided with internal threads of steep pitch to frictionally hold the screw in any axially adjusted position to which it is displaced by rotation of the adjustment knob 76.

It will be apparent from the foregoing description that by adjusting the tension of strap 72 through the adjustment means 26, frictional resistance to rotation of disc 42 will adjustably load either one of the pedals through the one-way clutches 44 and 46 transmitting torque in opposite directions. Further, since both pedals are displaced simultaneously in opposite directions because of the force transmitting linkage arrangement 32 herein before described, such displacement will occur in response to the prevailing foot pressure applied to one or the other of the pedals 14 and 16 thereby providing exercising activity for either one of the user's feet, with both feet in contact with the pedals. The mechanism for achieving the foregoing operational attributes of the device 10 are furthermore protectively enclosed within the housing 18 while the pedals remain fully exposed externally of the housing. Also, adjustment in effective pedal length is provided by alternative assembly of the pedal with the linkage arrangement 32 through pivot brackets 56 and 57. Toward that end, the pedals are pivotally supported independently of the housing by the rollers 64 externally of the housing.

Further, it will be appreciated by persons skilled in the art that various deviations from the described embodiment of the invention are possible and that modifications and improvements may be made within the scope and spirit of the invention not limited by the specific embodiment described, but only by the scope and spirit of the appended claims.

What is claimed is:

1. An exercising device, comprising a pair of pedals, means supporting the pedals in laterally spaced relation to each other for receiving foot pressure, linkage means interconnecting the pedals for simultaneous translational displacement in opposite directions in response to the foot pressure applied to either one of the pedals, said linkage means including a pair of links respectively connected to the pedals and positive force transmitting means operatively connected to said links for effecting said displacement of the pedals relative to each other in said opposite directions by equal amounts, said positive force transmitting means comprising a slide tube having opposite ends from which the links slidably project and a plurality of ball bearings slidably mounted within the tube in contact with each other and in operative engagement with the links, loading means operatively connected to the linkage means for resisting said foot pressure during said translational displacement of the pedals and means for selectively adjusting the resistance of the loading means to said foot pressure.

2. The device as defined in claim 1 wherein said loading means includes a common loading disc rotatably mounted in operative relation to the linkage means, gear means drivingly connecting the links to the loading disc for rotational displacement thereof and frictional means connected to the selective adjusting means for engaging the loading disc.

3. The device as defined in claim 2 wherein said gear means compresses gear rack formations on the links, pinion gears in mesh said gear rack formations and one-way clutch means operatively connecting the pinion gears to the common loading disc for alternately effecting said rotational displacement thereof.

4. The device as defined in claim 3 wherein said frictional means comprise a flexible band in peripheral engagement with loading disc and means for anchoring the flexible band under tension regulated by the selective adjusting means.

5. The device as defined in claim 4 including a housing enclosing the linkage means and the loading means, said housing having openings into which the links project from the pedals.

6. The device as defined in claim 5 wherein the supporting means comprises a pair of rollers and axle means mounted on the pedals for rotatably supporting the rollers in underlying relation thereto.

7. The device as defined in claim 6 including frame means internally fixed to the housing for mounting the slide tube and rotatably supporting the loading disc and frictional pad means connected to the frame means for establishing a supporting surface plane in common with said pair of rollers closely spaced below the housing.

8. The device as defined in claim 1 including a housing enclosing the linkage means and the loading means, said housing having openings into which the links project from the pedals.

9. An exercising device comprising a pair of pedals, means supporting the pedals in laterally spaced relation to each other for receiving foot pressure, a pair of links respectively connected to the pedals, positive force transmitting means operatively mounted in engagement with said links for limiting displacement thereof in opposite directions by equal amounts, a common loading disc, said transmitting means comprising a slide tube having opposite ends from which links slidably project and a plurality of ball bearings slidably mounted within the tube in contact with each other and in operative engagement with the links, gear means drivingly connecting the links to the loading disc for rotational displacement thereof in opposite directions and frictional means engaging the loading disc for loading thereof.

10. The device as defined in claim 9 wherein said gear means comprises gear rack formations on the links, pinion gears in mesh with said gear rack formations and one-way clutch means operatively connecting the pinion gears to the common loading disc for alternately transmitting torque thereto in said opposite directions of the rotational displacement.

11. The device as defined in claim 9 wherein said frictional means comprises a flexible band in peripheral engagement with the loading disc and means for anchoring the flexible band under selectively adjusted tension.

12. An exercising device comprising a housing, a pair of pedals, a loading disc rotatably mounted within the housing, roller means for support of the pedals externally of and independently of the housing, linkage means enclosed by the housing and interconnecting the pedals for simultaneous displacement in opposite directions under foot pressure applied to either one of the pedals, means for drivingly connecting the linkage means to the loading disc, frictional means engageable with the loading disc within the housing for resistance to the foot pressure applied to the pedals and means mounted on the housing in operative relation to the loading disc for selectively adjusting the resistance of the frictional means during said displacement by the pedals, said linkage means including a pair of links respectively connected to the pedals and positive force transmitting means operatively connected to said links for effecting said displacement of the pedals relative to each other in said opposite directions by equal amounts, said transmitting means comprising a slide tube having opposite ends from which the links slidably project and a plurality of ball bearings slidably mounted with the tube in contact with each other and in operative engagement with the links.

13. An exercising device, comprising a pair of pedals, a pair of links connected to the pedals, positive force transmitting means operatively connected to said links for effecting simultaneous displacement of the pedals relative to each other in opposite directions, loading means operatively connected to the links for resisting foot pressure applied to the pedals during said displacement thereof, means for selectively adjusting the resistance of the loading means to said foot pressure, a housing enclosing the positive force transmitting means and having openings into which the links project from the pedals, and means operatively connected to the pedals in underlying relation thereto for support thereof externally of the housing.

14. An exercising device comprising a housing, a pair of pedals, loading means drivingly connected to the pedals for resisting foot pressure applied thereto, means for support of the pedals on a floor surface externally and independently of the housing, linkage means enclosed by the housing and interconnecting the pedals for simultaneous displacement thereof in opposite directions under said foot pressure applied to either one of the pedals, means engageable with the loading means for selectively adjusting the resistance thereof during said displacement of the pedals and surface contact means connected to the housing for support thereof on the floor surface in coplanar relation with said support of the pedals thereon.

15. The combination of claim 13 wherein said support means comprises a pair of rollers and axle means mounted on the pedals for rotatably supporting the rollers in laterally spaced relation to each other.

16. The combination of claim 15 wherein said loading means comprises a frictional disc engageable by the selective adjusting means and means for drivingly connecting the disc to the links.

17. The combination of claim 14 wherein said loading means comprises a frictional disc engageable by the selective adjusting means and means for drivingly connecting the disc to the linkage means.

* * * * *